United States Patent [19]

Nordhus

[11] Patent Number: 4,915,826

[45] Date of Patent: Apr. 10, 1990

[54] GRAIN CLEANER

[76] Inventor: Larry Nordhus, Nemaha County, Rural Route, Centralia, Kans. 66415

[21] Appl. No.: 835,965

[22] Filed: Mar. 4, 1986

Related U.S. Application Data

[63] Continuation of Ser. No. 593,821, Mar. 27, 1984, abandoned, which is a continuation-in-part of Ser. No. 415,280, Sep. 7, 1982, abandoned.

[51] Int. Cl.[4] ..... B07B 1/22

[52] U.S. Cl. ..... 209/288; 209/247; 209/258; 209/290

[58] Field of Search ..... 209/288, 293, 294, 291, 209/296–299, 664, 634, 659, 680, 683, 687, 935, 289, 247, 290, 258; 366/228, 234

[56] References Cited

U.S. PATENT DOCUMENTS

| | | | |
|---|---|---|---|
| 694,568 | 3/1902 | Mason, Jr. | 366/234 X |
| 1,185,770 | 6/1916 | Cody | 209/664 |
| 1,216,891 | 2/1917 | Trefz . | |
| 1,822,921 | 9/1931 | Cooper | 209/683 X |
| 1,932,777 | 10/1933 | Germer | 209/687 |
| 2,543,898 | 3/1951 | De Vaney | 209/288 |
| 2,846,153 | 8/1958 | Krough | 209/299 X |
| 3,021,008 | 2/1963 | Christian | 209/299 |
| 4,115,257 | 9/1978 | Muyler | 209/291 |
| 4,361,239 | 11/1982 | Kumandan | 209/288 X |

FOREIGN PATENT DOCUMENTS

| | | | |
|---|---|---|---|
| 839256 | 12/1938 | France | 209/95 |
| 455750 | 8/1973 | U.S.S.R. | 209/289 |
| 976004 | 11/1964 | United Kingdom | 209/289 |

OTHER PUBLICATIONS

Russian Engineering Journal—Designing a drum for Sorting Scrap Metal Guzenko—Vol. L111—No. 2—pp. 45–48 (1973).

*Primary Examiner*—Donald T. Hajec

*Attorney, Agent, or Firm*—Kokjer, Kircher, Bradley, Wharton, Bowman & Johnson

[57] ABSTRACT

A grain cleaner and method for cleaning grain is the subject of the present invention. A single rotatable drum presents a substantially continuous screen surface of increasing mesh size from one end to another with the drum having an inlet end and an outlet end. A plurality of baffles are disposed in spaced apart relationship along the periphery of and along the length of the screen surface of the drum for retarding the flow of material therethrough. Retaining means is provided in the vicinity of the outlet end of the drum for retarding the flow of foreign material fromthe drum while accommodating the eventual passage of foreign material out of the drum. The drum is rotated by any conventional power source.

5 Claims, 1 Drawing Sheet

GRAIN CLEANER

This is a continuation of application Ser. No. 593,821, filed 3/27/84 which is a continuation-in-part application of Ser. No. 415,280; filed 9/7/82, and both now abandoned.

This invention relates generally to grain cleaners and, more particularly, to a grain cleaner employing a single rotating drum with structure in the drum for controlling the flow of material therethrough.

Various types of rotating screen cleaners have heretofore been employed for removing foreign material from harvested grain. It is, of course, desirable to employ a grain cleaner which is portable so that it may be moved to different areas where grain is being harvested or stored. Portable rotary grain cleaners heretofore utilized have fallen into two primary categories. One category is the single screen cleaner where grain passes into the rotating screen drum and gravitates to the far end. Such single screen constructions have not previously provided for controlled flow of grain through the drum and have also not provided for removal of relatively large foreign material which passes over the drum screen. The result has been somewhat unsatisfactory cleaning in some instances because of an inability to remove coarse material.

The second primary category of grain cleaners has been those employing a drum within a drum. The grain to be cleaned first passes along an inner screen and then along an outer screen. The two drums may rotate in the same direction or be counter-rotating. While such a construction does provide for improved cleaning of the grain, it requires longer time for the grain to pass through the drum. Furthermore, since the large screen portion is of design necessity part of the inner drum, this screen for separation of large foreigns must be relatively small in diameter thereby reducing the capacity of this type of cleaner.

OBJECTS OF THE INVENTION

It is therefore, a primary object of the present invention to provide a grain cleaner having a relatively large capacity without greatly increasing the diameter of the rotating drum.

As a corollary to the above object, an aim of the invention is to provide a grain cleaner having increased capacity for grain particularly in the lower section of the cleaner where about half the separation occurs thus permitting the mesh size in the ultimate separation section to be more closely matched to grain size thereby improving cleaning performance.

It is also one of the important objectives of this invention to provide a grain cleaner which controls the flow of both grain and foreign material through the cleaner much more evenly than prior constructions.

As a corollary to the above objective, one of the principal aims of my invention is to provide a grain cleaner which utilizes retention means for holding large foreign material in the cleaner for a relatively long period of time thus reducing significantly the carryover of grain with foreign material passing out through the end of the cleaner.

Another one of the objects of the invention is to provide a grain cleaner as described in the foregoing aims and objects which has improved accessibility to the screens of the rotating screen drum than prior art designs utilizing conical shaped screens and drum within a drum constructions.

An object of the invention is also to provide a grain cleaner having the advantages and meeting the objectives aforedescribed which canbe tilized with different grains through a relatively fast modification of the screens which make up the rotating drum.

Still another object of the invention is to provide a grain cleaner of the type described wherein three different sized screens may be utilized to separate grain into different fractions utilizing the same machine which cleans the grain.

Other objects of the invention will be made clear or become apparent from the following decription and claims when read in light of the accompanying drawing, wherein:

DETAILED DESCRIPTION OF THE INVENTION

Figure 1:
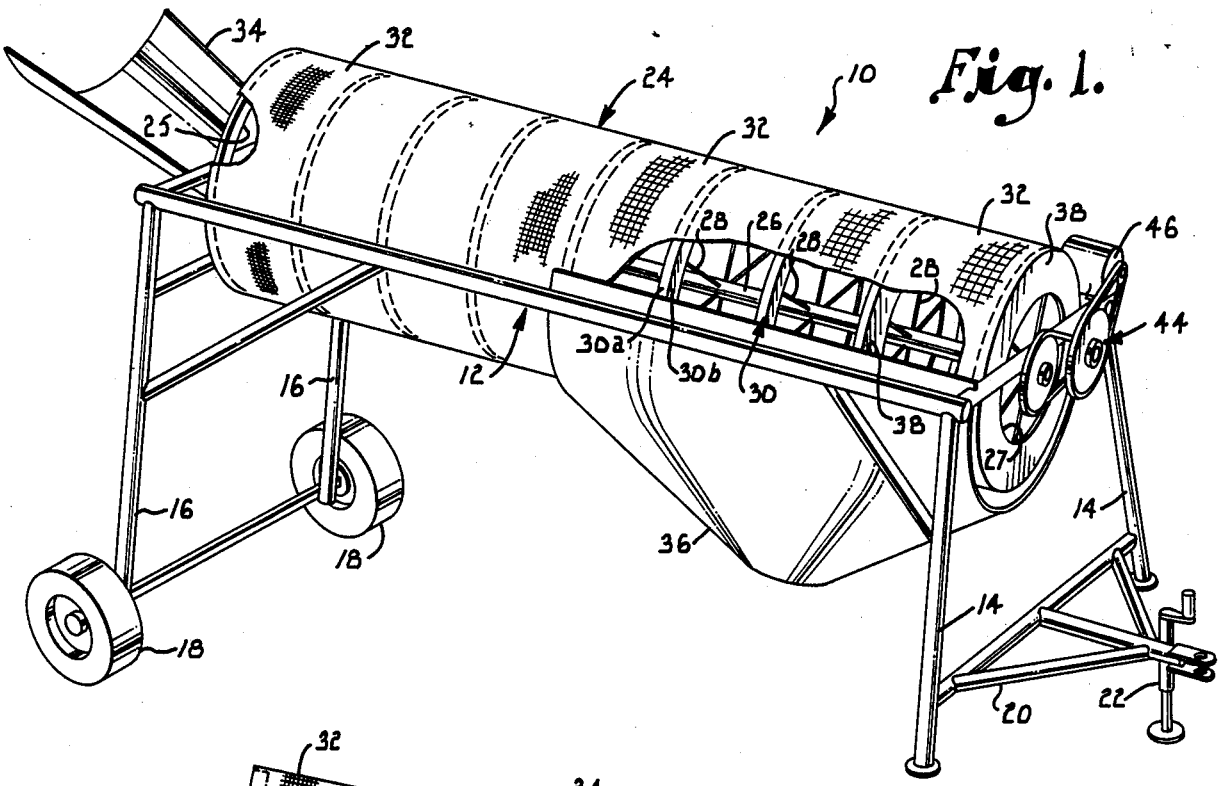
FIG. 1 is a perspective view of a grain cleaner according to the present invention.
Figure 2:
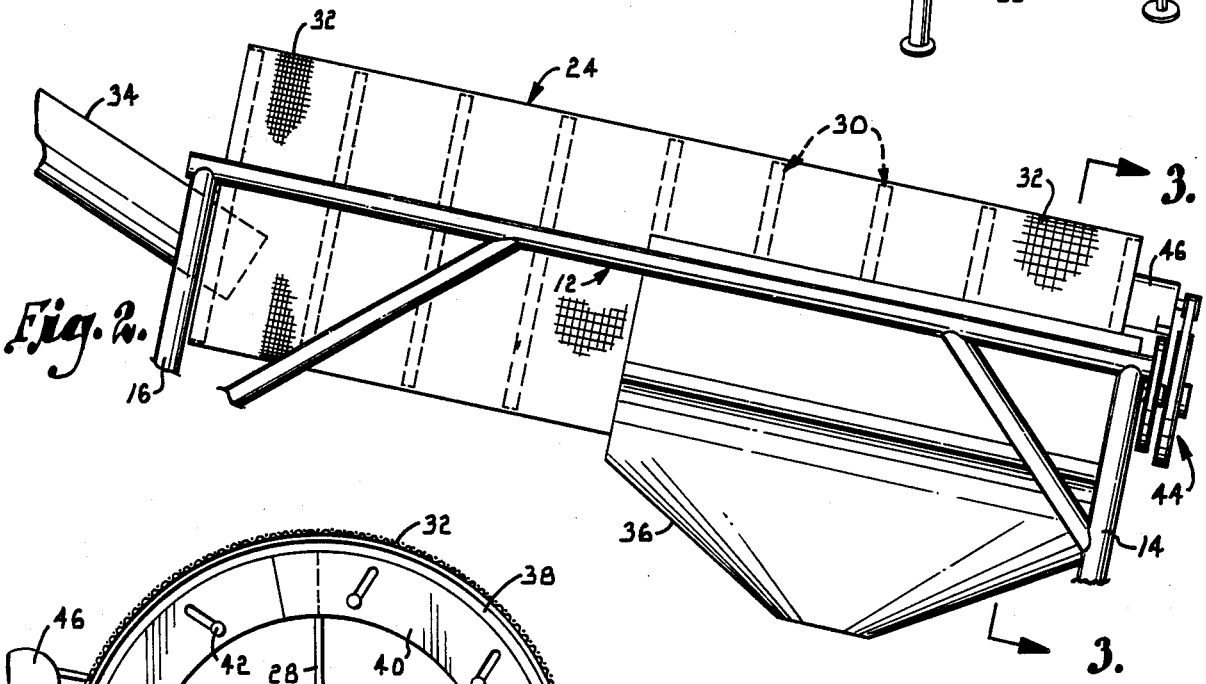
FIG. 2 is a side elevational view thereof on a slightly enlarged scale.

Referring initially to FIG. 1, the grain cleaner of the present invention is designated generally by the numeral 10. Cleaner 10 comprises a framework 12 having forward support legs 14 and rear support legs 16. Rear legs 16 are provided with wheels 18 and forward legs 14 are provided with a tongue assembly 20 so as to permit towing of the cleaner 10 behind a vehicle. A jack stand 22 helps to support the framework when the cleaner is in use. It is to be understood that legs 14 would also normally include telescoping sections (not shown) so as to assist in adjusting the height of the forward end of the framework, and thus the angle of inclination.

A unitary screen cleaner drum is mounted on framework 12 for rotation about its horizontal axis and is designated generally by the numeral 24. Drum 24 has an inlet 25 at one end and an outlet 27 at the opposite end. Cleaner drum 24 includes a longitudinally extending central axle 26 which is mounted by appropriate bearings (not shown) on framework 12. Projecting outwardly from axle 26 are a plurality of radially extending spokes 28 which in turn mount a plurality of peripheral baffle rims 30. Rims 30 may be constructed from rolled angle iron stock or equivalent material so as to present a generally horizontal surface 30*a* and a generally vertical surface 30*b*. The horizontal surfaces presented by the baffle rims 30 serve to mount a plurality of separating screens of varying mesh size all of which have been designated by the numeral 32 in the drawing. It is to be understood that there will normally be at least two different sizes of screens 32 with the finer screen being placed at the inlet end and the coarser screen being placed at the outlet end. The screens are secured with any type of well known fastener so as to permit their ready removal for cleaning or substitution of a different size screen if desird. It should be understood that more than two different size screens can be utilized.

A chute 34 is provided at the inlet end of drum 24 for directing grain to be cleaned into the drum. A hopper 36 extends along the lower end of drum 24 for catching cleaned grain passing through the coarser screen 32.

Also disposed within drum 24 and mounted by spokes 28 is retaining means for relatively large foreign material which does not pass through screens 32. This retaining means comprises first and second end baffles 38 which extend toward the center of the drum at least twice as far as the vertical surfaces 30*b* of baffle rims 30. The area between end baffles 38 provides a zone for catching foreign material. The presence of this zone is an important aspect of the present invention.

Figure 3:
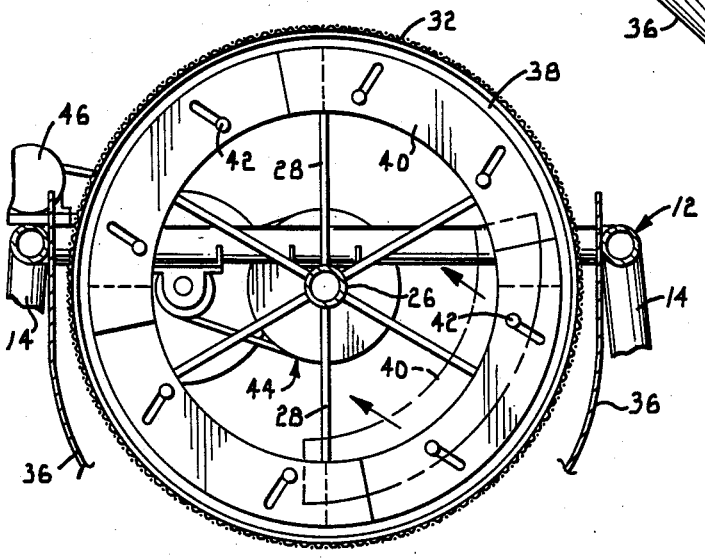
FIG. 3 is a vertical cross-sectional view taken along line 3—3 of FIG. 2.

As illustrated in FIG. 3, each of the end baffles 38 is provided with adjustable extension plates 40 secured by nut and bolt assemblies 42. These extension plates are utilized to vary the effective height of the end baffles.

A drive assembly designated generally by the numeral 44 comprises reduction pulleys and drive belts to couple drum 24 with a prime mover such as an electric motor 46. It is to be understood, of course, that a gasoline motor or the power takeoff of a tractor could also be utilized to power the grain cleaner 10.

OPERATION

In actual use, cleaner 10 is disposed at a slight angle so as to cause grain passing therethrough to move from the inlet end 25 to the outlet end 27 where the grain will drop into hopper 36. Drum 24 is rotated at a relatively slow rate of speed so as to subject the grain to the cleaning action of screens 32. As the grain is introduced into the drum at inlet 25, the fine foreign material will pass through the fine screens at this end. Passage of the grain along the surface of the screen drum is restricted by virtue of the vertical baffle surfaces 30*b* of baffle rims 30. This increases the holding time of the grain in the cleaner thereby resulting in a more effective cleaning operation. It should be noted that the foreign material which does not pass through screens 32 will, because of its relatively light weight and "stringy" characteristics be carried upwardly by the rotating screen drum until the gravitational forces cause it to drop from the screen. Because of the angle of inclination of the drum, the foreign material will tend to fall to the opposite side of the baffle immediately in front of it thus causing a continuous movement of foreign material toward the outlet end of the drum.

As the grain moves downwardly along the screen surface of drum 24, it will reach the larger mesh screens where it can pass through and into hopper 36. The relatively large and often "stringy" pieces of foreign material will continue to move toward outlet 27 where they will reach first end baffle 38. Because this end baffle projects a greater distance toward the center of the drum, it will serve to retain the foreign material in the drum for a longer period of time than would otherwise be the case. This additional retention time will help to clear usable grain from the foreign material thus greatly reducing the amount of carryover of grain with the foreigns. Eventually, the buildup of foreign material will be sufficient that it will spill over baffle 38 and pass out of outlet 27. The second end baffle 38 which is spaced upstream slightly from the first end baffle serves to hold the foreign material in the end zone of the drum where it will not interfere with passage of cleaned grain into hopper 36. Also, the area between the two end baffles provides an "open zone" where the bulk of the grain in the cleaner is not interfering with the ultimate separation of the cleaned grain as it drops through the screen and into the hopper. While utilization of the second end baffle 38 spaced upstream from the first end baffle is not essential to the present invention, the results obtained are greatly enhanced when this second end baffle is employed. Even without the second baffle, an effective zone for handling foreign material can be provided by the first end baffle 38. It should also be understood that hopper 36 may be made of a screen material so that the grain will be subject to further cleaning as it drops through the hopper. To this end, a fan may be employed in close proximity to the hopper to help blow out foreign material.

From the foregoing, it will also be appreciated that the present invention encompasses a method of cleaning grain utilizing a single rotatable drum having an inlet end and an outlet end and a substantially continuous screen surface of increasing mesh size from the inlet end to the otlet end. The dru is disposed at an angle relative to the horizontal so the grain will gravitate from the inlet end to the outlet end with the method steps comprising: rotating the drum about its horizontal axis; introducing grain to be cleaned into the inlet end; retarding the passage of grain through the drum during rotation so as to allow small foreign material to pass through the fine screen; and restricting larger foreign material passing over the screen from exiting through the outlet end thereby increasing the retention time of the material in the drum and reducing the amount of grain lost as a result of carryover with the foreigns through the outlet end. The cleaned grain is, of course, allowed to pass through the relatively large mesh screen in the vicinity of the outlet end of the drum.

By utilizing the method and apparatus of the present invention, superior grain cleaning can be achieved with a relatively simple single drum cleaner. Superior cleaning is achieved as a result of the control of flow of grain through the cleaner and the unique manner of handling foreign material which does not pass through the screen. Since the screen section where secondary separation of the cleaned grain occurs is of the same diameter as the remainder of the drum, the screen in this section may be closely sized to the size of the grain thus further enhancing the quality of the cleaning operation and the retaining capacity.

I claim:

1. A grain cleaner for receiving grain and foreign material and separating the grain from the foreign material, said grain cleaner comprising:

a framework;

a rotatable drum having opposite ends defining an inlet at one end for receiving grain to be cleaned and an outlet at the opposite end for discharging relatively large particles of foreign material separated from the grain, said drum presenting a substantially continuous screen surface of increasing mesh size from the inlet toward the outlet with a first portion of said screen surface adjacent said inlet having a mesh size to prevent passage of the grain therethrough but allow passage of relatively small particles of foreign material therethrough, and a second portion of said screen surface adjacent said outlet having a mesh size to permit passage of grain therethrough but prevent passage of relatively large particles of foreign material therethrough, said screen surface being subtantially cylindrical and uniform in diameter between said inlet and outlet;

means for mounting said drum for rotation on said framework about an axis which inclines downardly from said inlet to said outlet of the drum;

means for rotating said drum about said axis to transport material through the drum with the relatively small particles of foreign materials being discharged from the drum through said first portion of the screen surface and the grain passing through said second portion of the screen surface;

a hopper supported on said framework at a location to underlie the entirety of said second portion of the screen surface but not said first portion thereof, whereby said hopper receives the grain passing through the second portion but not small particles of the foreign material passing through said first portion and out of the drum;

a plurality of relatively small baffles in said drum spaced apart from one another along said first portion of the screen surface and an upstream end of said second portion, said baffles projecting inwardly from said screen surface and and retarding the flow of material through the drum; and an end baffle in said drum adjacent said outlet and acting to retard the flow of said large particles out through said outlet and to effect a buildup of said large particles on a downstream end of said second portion to thereby impede grain mixed with said large particles from being carried therewith out through said outlet, said end baffle acting to restrict flow therepast to a greater extent than said relatively small baffles.

2. A grain cleaner as set forth in claim 1, including a second end baffle in said drum disposed on said downstream end of said second portion at a location upstream from the first mentioned end baffle and cooperating therewith to present a space for said large particles to build up between the end baffles.

3. A grain cleaner as set forth in claim 2, including means for adjusting each of said end baffles to vary its ability to retard the flow of material therepast.

4. A grain cleaner as set forth in claim 1 including:

a plurality of extension plates on said end baffle, said extensin plates cooperating to define said outlet; and means for adjusting said extension plates radially of the drum to thereby adjust the size of said outlet.

5. A grain cleaner as set forth in claim 4, wherein said adjusting means comprises slot and fastener means for securing said extension plates to said end baffle.

* * * * *